US011918169B2

(12) United States Patent
Fang et al.

(10) Patent No.: US 11,918,169 B2
(45) Date of Patent: Mar. 5, 2024

(54) HANDHELD VACUUM CLEANER AND HANDHELD AND UPRIGHT INTEGRATED VACUUM CLEANER

(71) Applicant: NINGBO FUJIA INDUSTRIAL CO., LTD., Ningbo (CN)

(72) Inventors: Jianqiang Fang, Ningbo (CN); Jianming Zheng, Ningbo (CN); Wenxian Wu, Ningbo (CN)

(73) Assignee: NINGBO FUJIA INDUSTRIAL CO., LTD., Ningbo (CN)

( * ) Notice: Subject to any disclaimer, the term of this patent is extended or adjusted under 35 U.S.C. 154(b) by 89 days.

(21) Appl. No.: 17/642,234

(22) PCT Filed: Jul. 6, 2020

(86) PCT No.: PCT/CN2020/100407

§ 371 (c)(1),
(2) Date: Mar. 11, 2022

(87) PCT Pub. No.: WO2021/047263

PCT Pub. Date: Mar. 18, 2021

(65) Prior Publication Data

US 2022/0322897 A1 Oct. 13, 2022

(30) Foreign Application Priority Data

Sep. 11, 2019 (CN) ..... 201910858635.8

(51) Int. Cl.

| | |
|---|---|
| ***A47L 5/24*** | (2006.01) |
| ***A47L 9/16*** | (2006.01) |
| ***A47L 9/32*** | (2006.01) |

(52) U.S. Cl.
CPC ..... *A47L 5/24* (2013.01); *A47L 9/1683* (2013.01); *A47L 9/322* (2013.01)

(58) Field of Classification Search
CPC ... A47L 5/24; A47L 5/225; A47L 5/26; A47L 9/1683; A47L 9/322; A47L 9/106;
(Continued)

(56) References Cited

U.S. PATENT DOCUMENTS 5,966,774 A * 10/1999 Bone ..... A47L 9/106 15/352
2015/0135474 A1 5/2015 Gidwell
2017/0079489 A1* 3/2017 Dimbylow ..... A47L 5/28

FOREIGN PATENT DOCUMENTS

CN 109008792 A 12/2018
EP 0914795 A2 5/1999
(Continued)

OTHER PUBLICATIONS

Japan Office Action, Japan Application No. JP2022516209, dated Apr. 26, 2023.
(Continued)

*Primary Examiner* — Don M Anderson
*Assistant Examiner* — Christopher Soto

(57) ABSTRACT

A handheld vacuum cleaner includes a frame, and a dust barrel and a locking portion mounted on the frame, wherein a front end of the dust barrel and the locking portion are movable relative to each other and are arranged opposite to each other; the dust barrel has a rotatable front cover at a front side thereof; and when the locking portion and the dust barrel move with respect to each other, the front cover is automatically rotatable to open, or close on the front side of the dust barrel due to limit by the locking portion.

20 Claims, 19 Drawing Sheets

(58) Field of Classification Search
CPC .... A47L 9/1625; A47L 9/1641; A47L 9/1691; A47L 9/22; A47L 9/2884; A47L 9/00; A47L 9/02; A47L 9/10
See application file for complete search history.

(56) References Cited

FOREIGN PATENT DOCUMENTS

| | | | | |
|---|---|---|---|---|
| EP | 0914795 | A3 | 11/1999 | |
| WO | WO-2019130014 | A1 * | 7/2019 | ..... A47L 5/24 |

OTHER PUBLICATIONS

European Office Action, European Application No. EP20862892.5, dated Jun. 12, 2023.
European Search Report, European Application No. EP20862892, dated Sep. 12, 2022.
International Search Report issued in corresponding International application No. PCT/CN2020/100407, dated Sep. 30, 2020.
Written Opinion of the International Search Authority in corresponding International application No. PCT/CN2020/100407, dated Oct. 9, 2020.

* cited by examiner

HANDHELD VACUUM CLEANER AND HANDHELD AND UPRIGHT INTEGRATED VACUUM CLEANER

TECHNICAL FIELD

The present disclosure relates to the technical field of vacuum cleaners, and particularly to a handheld vacuum cleaner and a handheld and upright integrated vacuum cleaner.

BACKGROUND

At present, opening a dust barrel in a vacuum cleaner and removing dust from the dust barrel are extremely complicated. The dust barrel available in the market mainly includes an overall disassembly type dust barrel and a front flip type dust barrel, wherein for the front flip type dust barrel, a buckling portion is required to be manually opened to realize that a front cover is rotated and opened, which is inconvenient.

SUMMARY

In view of the problems mentioned in the prior art, provided are a handheld vacuum cleaner capable of automatically opening a dust barrel for removing dust, and a handheld and upright integrated vacuum cleaner, to overcome the above-mentioned technical defects.

Specific technical solutions are described below.

A handheld vacuum cleaner includes a frame, and a dust barrel and a locking portion which are mounted on the frame. A front end of the dust barrel and the locking portion are movable relative to each other and are arranged opposite to each other. The dust barrel has a rotatable front cover at a front side thereof. When the locking portion and the dust barrel move with respect to each other, the front cover is automatically rotatable to open, or close on the front side of the dust barrel due to limited by the locking portion to be covered.

Preferably, a rear end of the dust barrel is connected with an electric fan assembly, a rear end of the electric fan assembly is hinged on the frame, and a front end of the dust barrel is rotatable around a hinged end of the electric fan assembly to be disengaged from a locking position of the locking portion, so that the front cover is automatically opened.

Preferably, the dust barrel is fixedly mounted on the frame, a lower end of the locking portion is hinged on the frame and the locking portion is rotatable to open relative to the frame; after the locking portion is rotated, the front cover of the dust barrel is automatically rotated and opened and after the locking portion is reset, the front cover is driven to be covered on a front end of the dust barrel.

Preferably, the locking portion is fixedly mounted on a front end of the frame, and the dust barrel is mounted on the frame and liftable by a lifting member, and after the dust barrel is lifted, the front cover of the dust barrel is released from a locking position of the locking portion and automatically rotated and opened.

Preferably, a lower end of the front cover is hinged to a lower end of the front side of the dust barrel by means of a rotating member; the rotating member includes a connecting shaft, a fixed sleeve mounted around the connecting shaft, and a torsional spring embedded within the fixed sleeve and mounted around the connecting shaft; edges of the lower ends of the front cover and the dust barrel are coaxially connected by the connecting shaft; the fixed sleeve is snapped onto the dust barrel; and one end of the torsional spring abuts against an outer edge of the front cover and provides the front cover with a rotating force relative to the dust barrel.

Preferably, a linkage limiting assembly is provided within the frame. The linkage limiting assembly includes a triggering button arranged at the rear end of the frame, a pushing member configured to push an electric fan assembly or the dust barrel upwards, a limiting member configured to limit the maximum stroke of the electric fan assembly or the dust barrel, and a linking member connecting the triggering button with the limiting member in a force transmission manner.

Preferably, the electric fan assembly or the dust barrel has a buckling structure at a lower end thereof opposite to the limiting member, the limiting member is mounted within the frame and rotatable forth and back, and one end of the linking member away from the triggering button abuts against the limiting member for driving the limiting member to perform a rotating action. One side of the limiting member facing the buckling structure has a first flange buckling portion for limiting the minimum stroke of the buckling structure, and the frame has a second flange buckling portion therein for limiting the maximum stroke of the buckling structure.

Preferably, one side of the locking portion facing the front end of the frame is provided with a first detachable connecting member, and one side of the front end of the frame facing the locking portion is provided with a second detachable connecting member corresponding to the first detachable connecting member in structure.

Preferably, the dust barrel is fixedly mounted on the frame, the locking portion is a pushing rod mounted inside the frame, the lower end of the front cover is connected with an L-shaped connecting rod, one end of the pushing rod is hinged with one end of the front cover away from the connecting rod, and the other end of the pushing rod is connected to a button on a rear end of the frame.

The present disclosure further provides a handheld and upright integrated vacuum cleaner, including the above-mentioned handheld vacuum cleaner, a connecting pipe detachably connected to a front end of the locking portion, and a floor brushing assembly mounted at one end of the connecting pipe away from the handheld vacuum cleaner.

The technical solutions have the following beneficial effects.

The handheld vacuum cleaner includes the frame, the dust barrel, and the locking portion. The dust barrel and the locking portion can move with respect to each other, and during the movement, the front cover is automatically opened or limited by the locking portion to be covered on the dust barrel, such that the front cover may be conveniently unlocked by means of the movement of the dust barrel and/or the locking portion, and further the dust barrel may be automatically opened for removing dust, without specially disassembling the dust barrel and manually opening the front cover for removing dust. Accordingly, the operation of removing dust is greatly facilitated and the convenience and reliability are brought for the operation.

DESCRIPTION OF THE EMBODIMENTS

Figure 10:
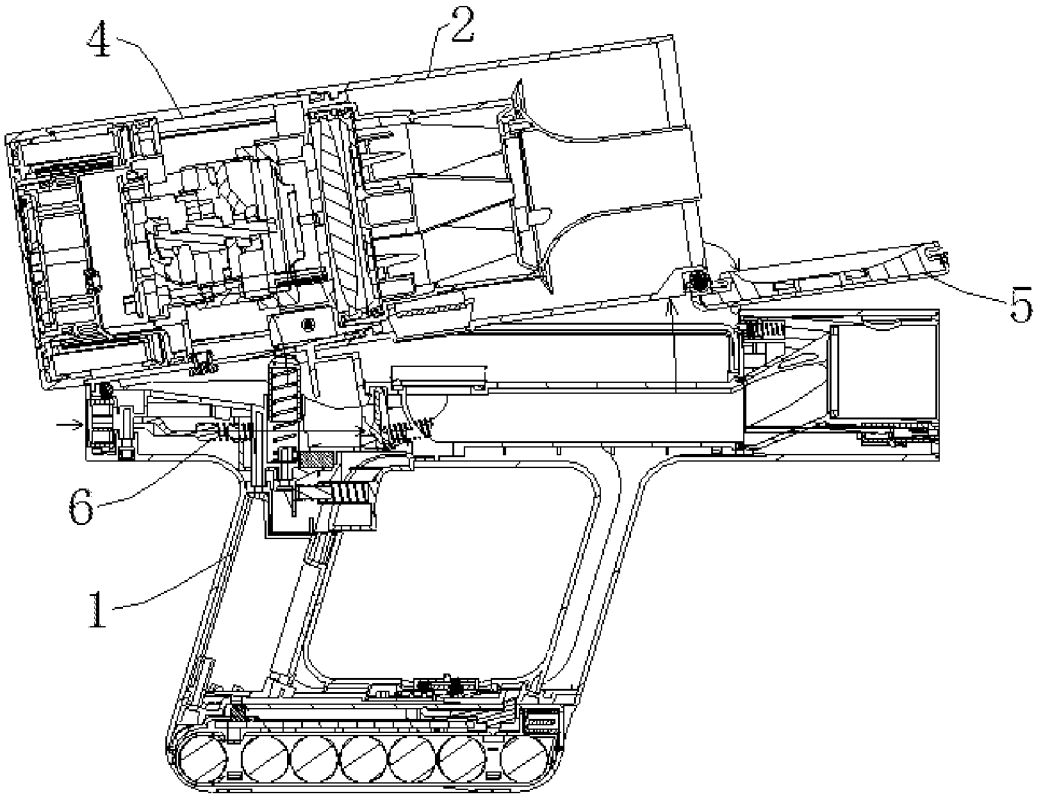
FIG. 10 is a cross-sectional view of the handheld vacuum cleaner in the use state according to the first embodiment of the present disclosure.
Figure 11:
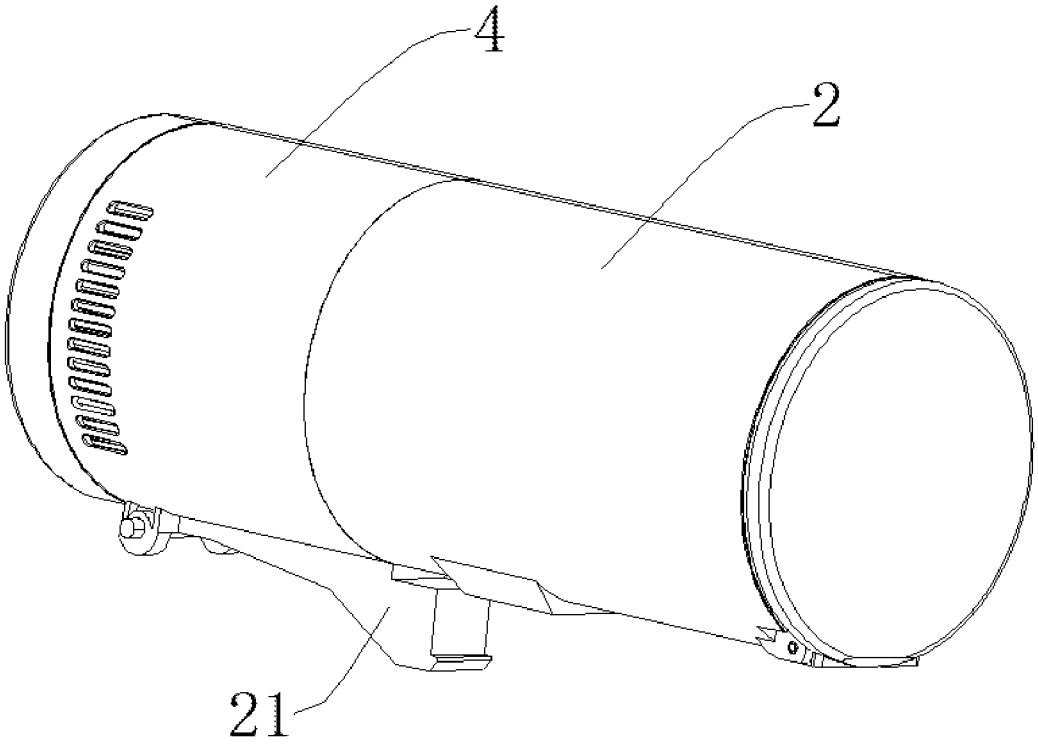
FIG. 11 is a perspective view showing an electric fan assembly of the handheld vacuum cleaner according to the first embodiment of the present disclosure.
Figure 12:
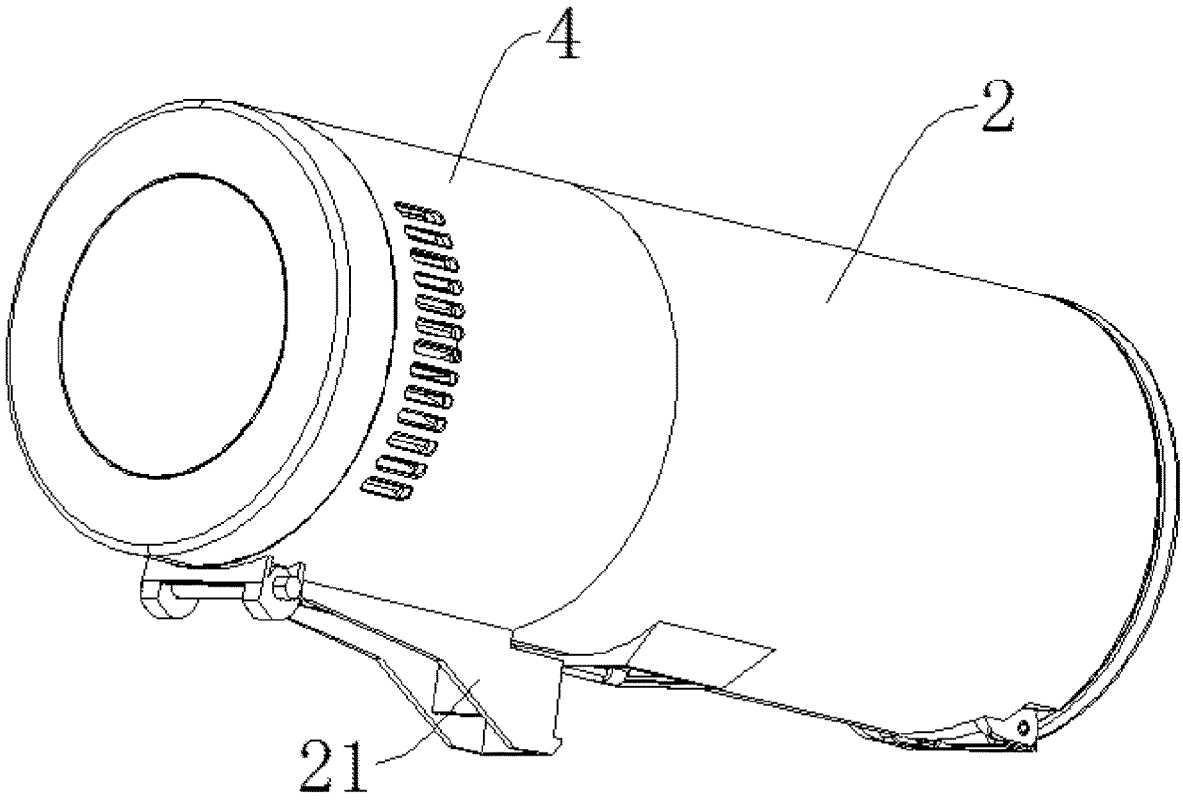
FIG. 12 is a perspective view showing the electric fan assembly of the handheld vacuum cleaner from a different aspect according to the first embodiment of the present disclosure.
Figure 13:
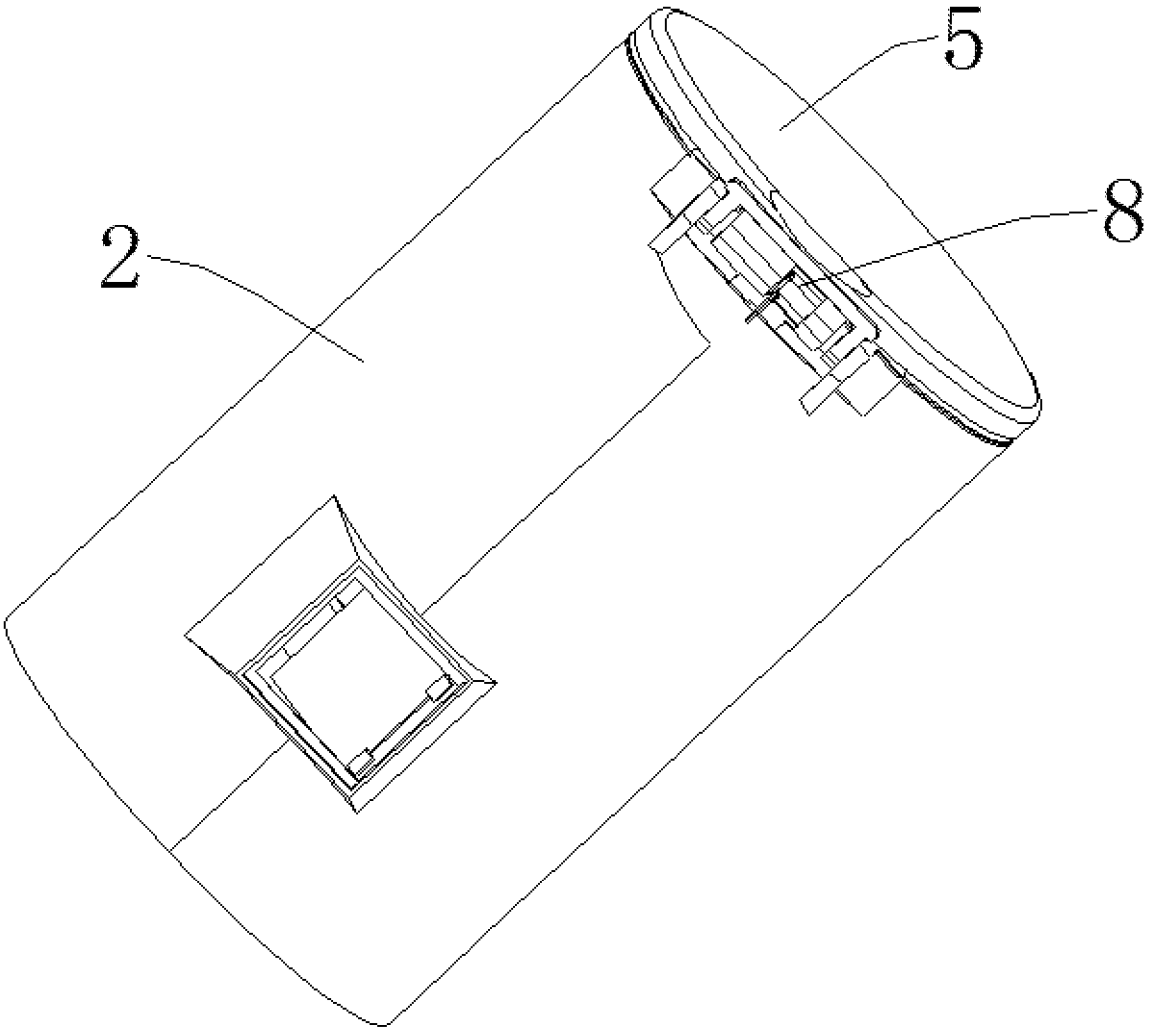
FIG. 13 is a perspective view showing a dust barrel of the handheld vacuum cleaner according to the first embodiment of the present disclosure.
Figure 14:
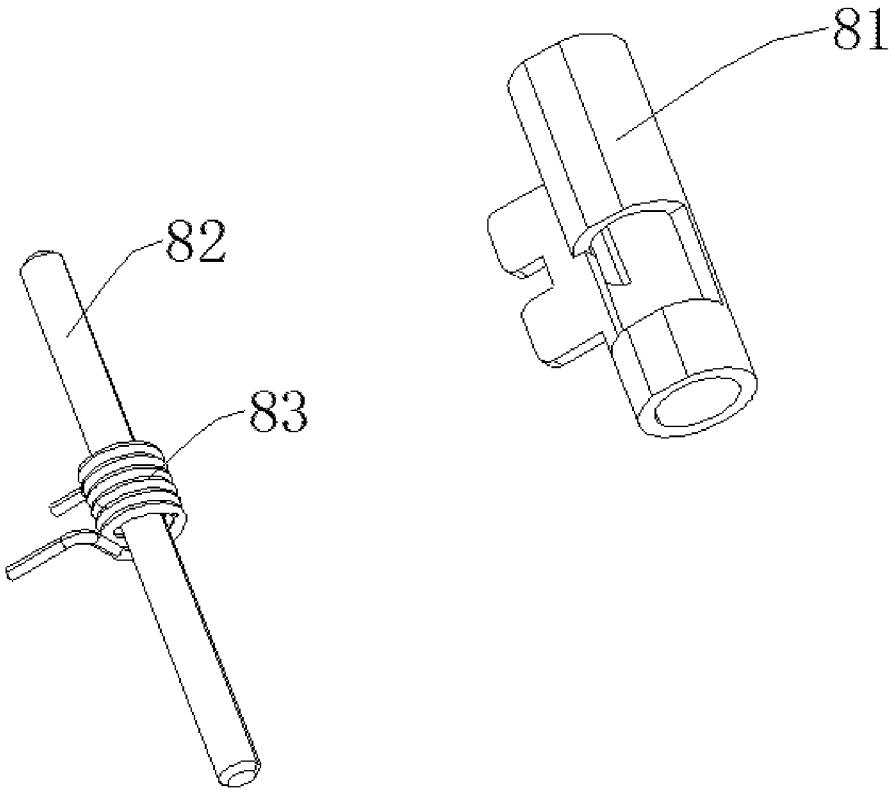
FIG. 14 is an exploded view showing a rotating member of the handheld vacuum cleaner according to the first embodiment of the present disclosure.

In order to easily understand technical means, creation features, achieved goals and effects of the utility model, the following embodiments will specifically describe the utility model in conjunction with accompanying drawings. A direction from right to left as shown in FIG. 10 is defined as a direction from front to back in the present disclosure.

First Embodiment

With reference to FIG. 1 to FIG. 14, the handheld vacuum cleaner provided in this embodiment includes a frame 1, and a dust barrel 2 and a locking portion 3 which are mounted on the frame 1, wherein a front end of the dust barrel 2 and the locking portion 3 may move with respect to each other and are opposite in position. Moreover, the dust barrel 2 has a rotatable front cover 5 at a front side thereof. When the locking portion 3 and the dust barrel 2 move with respect to each other, the front cover 5 may be automatically rotated and opened or limited by the locking portion 3 to be covered on the front side of the dust barrel 2.

Based on the above technical solution, the handheld vacuum cleaner includes the frame 1, the dust barrel 2, and the locking portion 3. The dust barrel 2 and the locking portion 3 can move with respect to each other, and during the movement, the front cover 5 is automatically opened or limited by the locking portion 3 to be covered on the dust barrel 2, such that the front cover 5 may be conveniently unlocked by means of the movement of the dust barrel 2 and/or the locking portion 3, and further the dust barrel 2 may be automatically opened for removing dust, without specially disassembling the dust barrel 2 and manually opening the front cover 5 for removing dust. Accordingly, the operation of removing dust is greatly facilitated and the convenience and reliability are brought for the operation.

Figure 9:
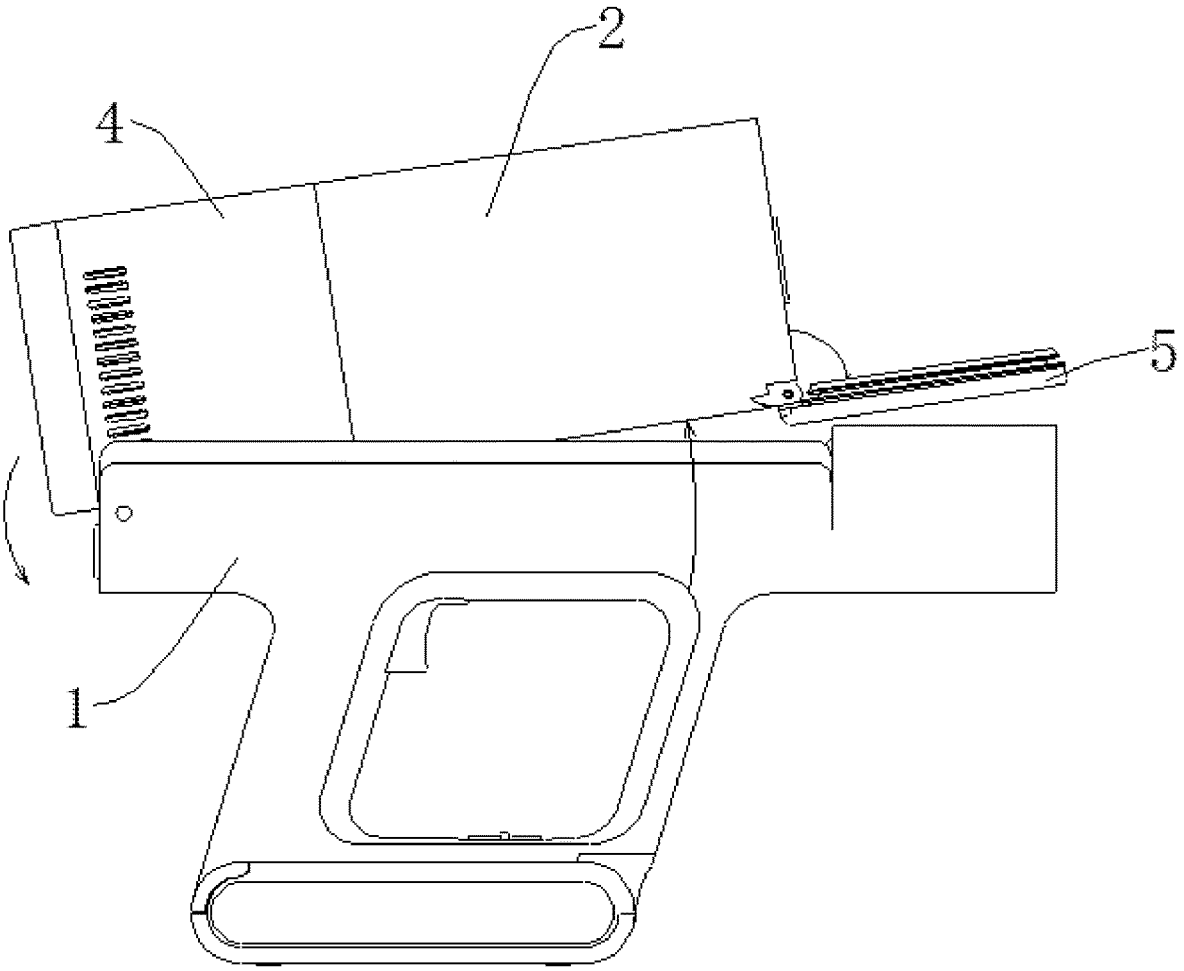
FIG. 9 is a side view of the handheld vacuum cleaner in a use state according to the first embodiment of the present disclosure.

In a preferred embodiment, with reference to FIGS. 2, 3, 9 and 10, in this embodiment, a rear end of the dust barrel 2 is connected with an electric fan assembly 4, a rear end of the electric fan assembly 4 is hinged on the frame 1, and a front end of the dust barrel 2 is capable of rotating around a hinged end of the electric fan assembly 4 to be disengaged from a locking position of the locking portion 3, and automatically opening the front cover 5. It is worth noting that, with a graph shown in FIG. 9 as an example, the electric fan assembly 4 and the dust barrel 2 may be rotated backwards around the hinged end as shown in FIG. 9 or rotated towards both sides under the support of a special-shaped structure, but not limited thereto.

As a further preferred embodiment, a linkage limiting assembly 6 is mounted within the frame 1. The linkage limiting assembly 6 includes a triggering button 61 arranged at a rear end of the frame 1, a pushing member 64 configured to push an electric fan assembly 4 or a dust barrel 2 upwards, a limiting member 63 configured to limit the maximum stroke of the electric fan assembly 4 or the dust barrel 2, and a linking member 62 connecting the triggering button 61 with the limiting member 63 in a force transmission manner. In this way, it is extremely convenient for a user to press the triggering button 61 with the thumb to remove dust instantly while holding the frame 1. Further, with reference to FIG. 3 to FIG. 7, FIG. 11 and FIG. 12, the electric fan assembly 4 or the dust barrel 2 has a buckling structure 21 opposite to the limiting member 63 at a lower end thereof, and the limiting member 63 is mounted within the frame 1 and is rotatable back and forth, and one end of the linking member 62 away from the triggering button 61 abuts against the limiting member 63 for driving the limiting member 63 to perform a rotating action. One side of the limiting member 63 facing the buckling structure 21 has a first flange buckling portion for limiting the minimum stroke of the buckling structure 21, and the frame 1 has a second flange buckling portion inside for limiting the maximum stroke of the buckling structure 21. Specifically, the buckling structure 21 has a buckle at a lower end thereof, and the first flange buckling portion and the second flange buckling portion have stepped structures at lower end faces thereof corresponding to the buckling structure 21 in shape.

Figure 5:
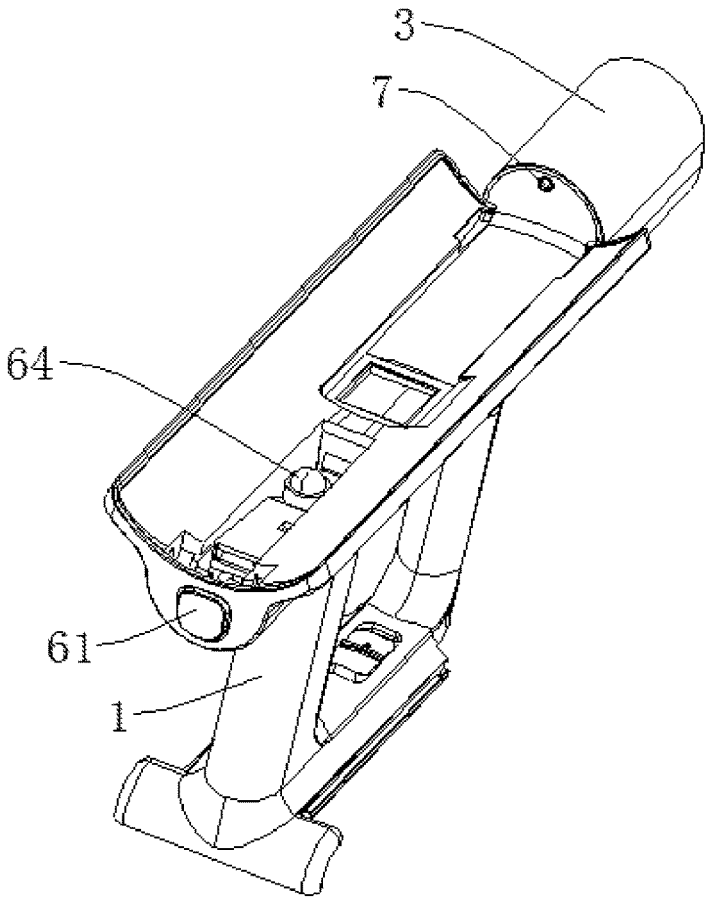
FIG. 5 is a perspective view showing a frame of the handheld vacuum cleaner according to the first embodiment of the present disclosure.
Figure 6:
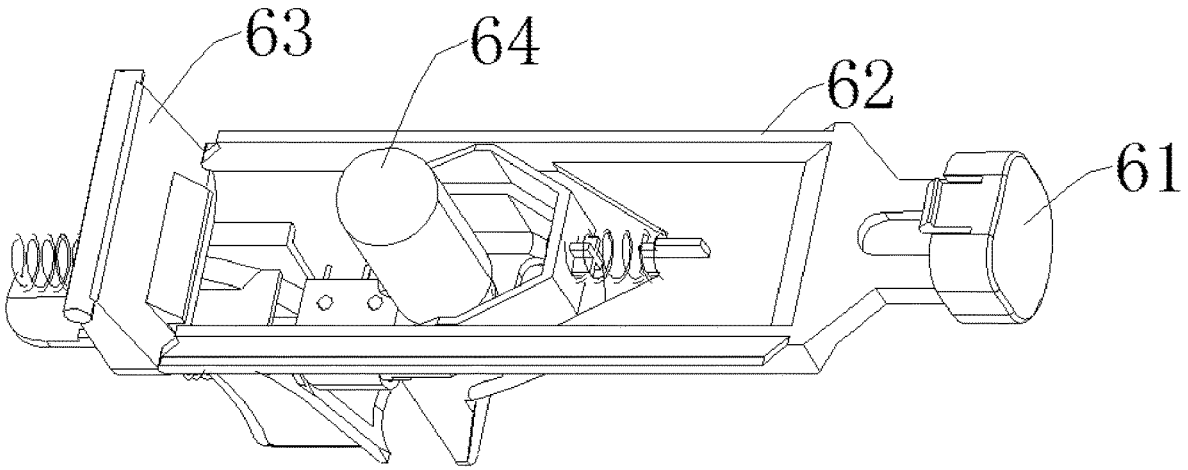
FIG. 6 is a perspective view showing a linkage limiting assembly of the handheld vacuum cleaner according to the first embodiment of the present disclosure.
Figure 7:
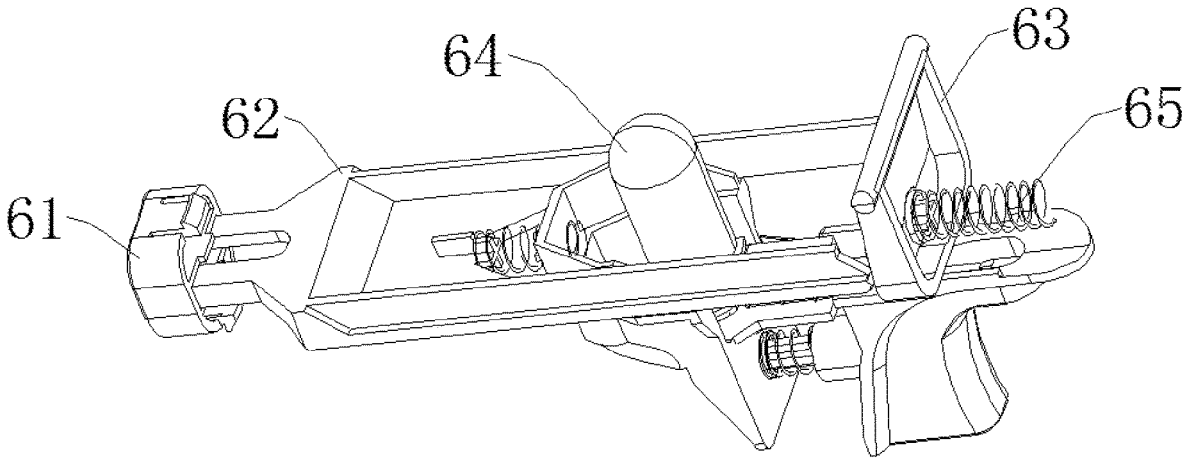
FIG. 7 is a perspective view showing the linkage limiting assembly of the handheld vacuum cleaner from a different aspect according to the first embodiment of the present disclosure.

As a further preferred embodiment, a first spring 65 is embedded within the frame 1, and two ends of the first spring 65 respectively abut against the inner wall of the frame 1 and one side of the limiting member 63 away from the buckling structure 21. Further, the pushing member 64 includes a pushing sleeve, wherein the pushing sleeve has an opening at a lower end thereof and a second spring is embedded within the opening, for driving the pushing sleeve to push the dust barrel 2 or the electric fan assembly 4 by means of the second spring. Moreover, the first spring 65 and the second spring may be replaced by an apparatus such as a plastic elastic column. The pushing member 64 may be an integral elastic column, which is not limited thereto. Meanwhile, it is worth noting that, as shown in FIG. 5, the frame 1 has openings for the components described above to protrude upwards, which is relatively conventional. Accordingly, the detailed description will be omitted here.

Figure 1:
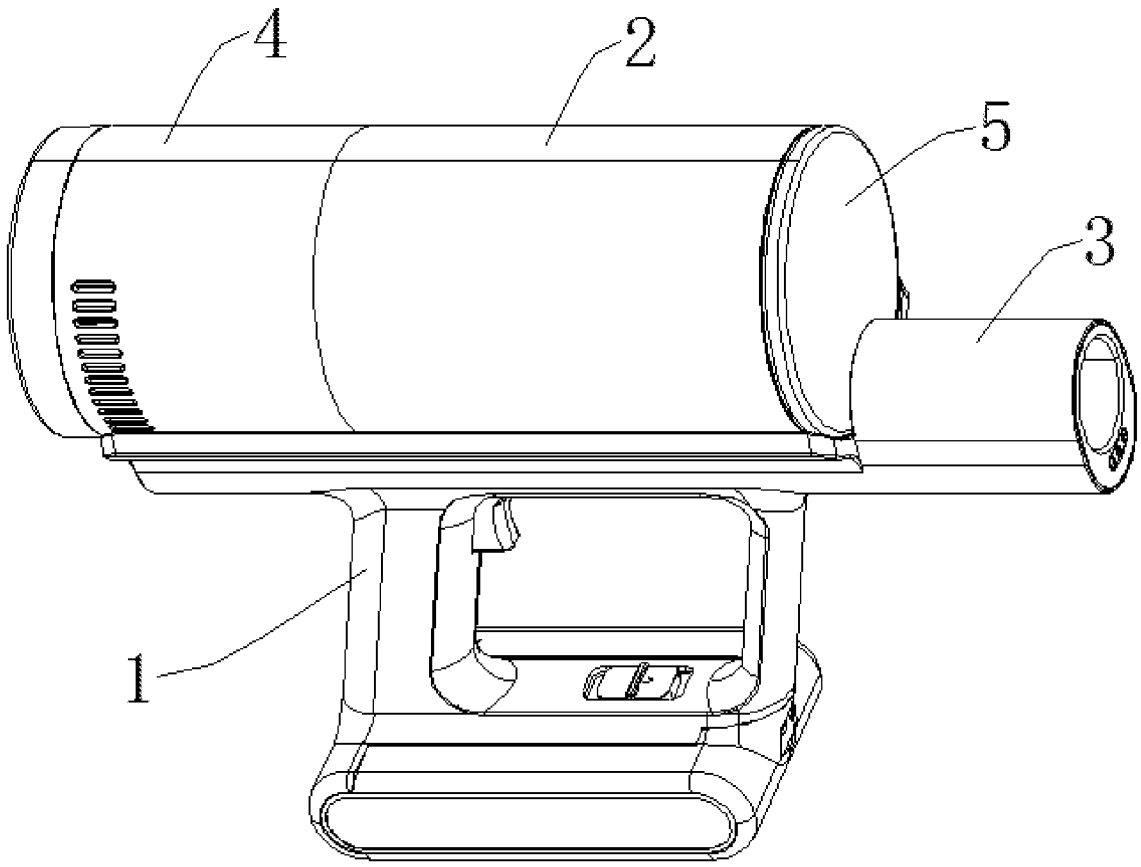
FIG. 1 is a perspective view of a handheld vacuum cleaner according to a first embodiment of the present disclosure.
Figure 2:
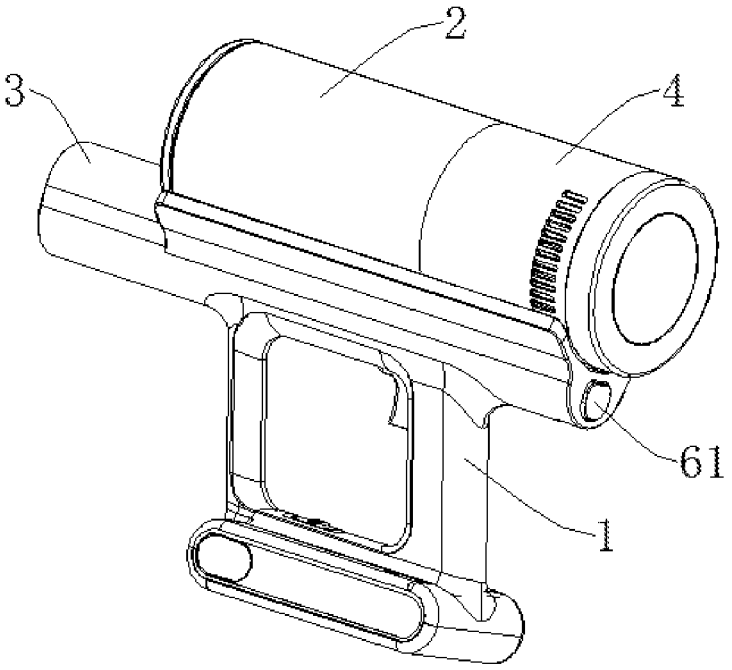
FIG. 2 is a perspective view of the handheld vacuum cleaner from a different aspect according to the first embodiment of the present disclosure.
Figure 3:
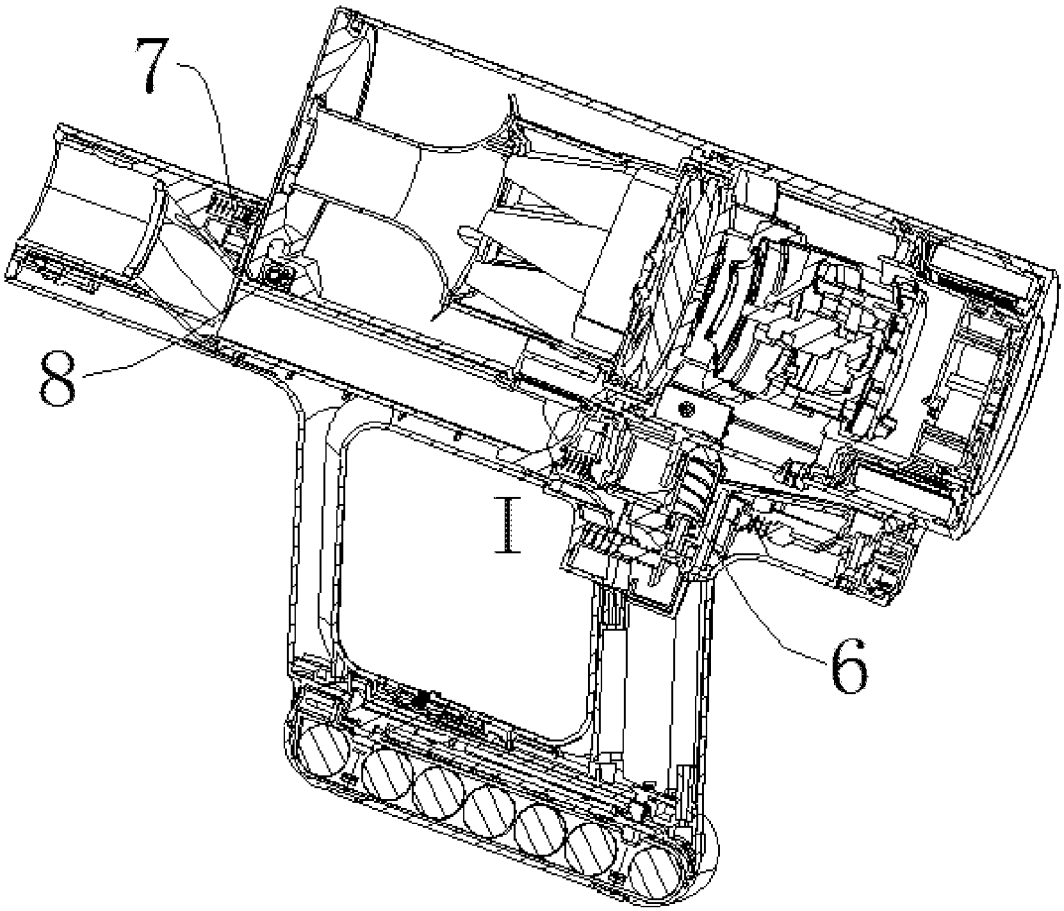
FIG. 3 is a cross-sectional perspective view of the handheld vacuum cleaner according to the first embodiment of the present disclosure.
Figure 4:
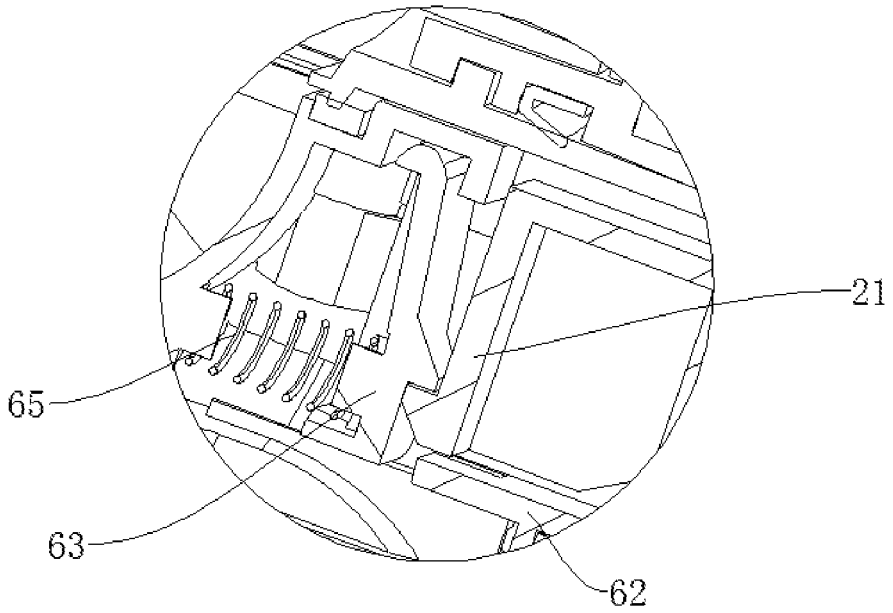
FIG. 4 is a partial enlarged view showing a portion I in FIG. 3.
Figure 8:
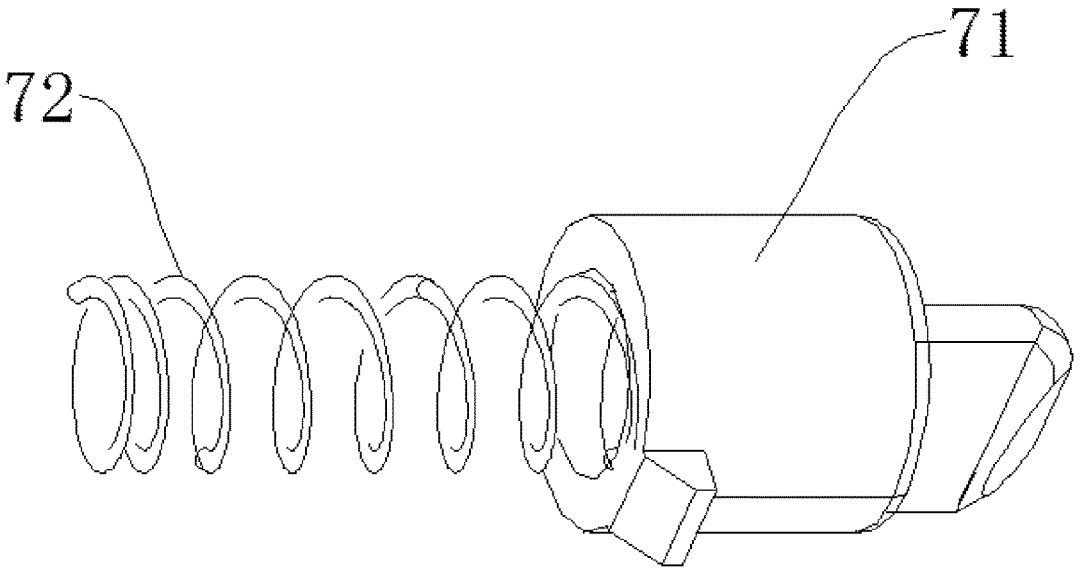
FIG. 8 is a perspective view showing a limiting assembly of the handheld vacuum cleaner according to the first embodiment of the present disclosure.

In a preferred embodiment, as shown in FIG. 3, FIG. 5, and FIG. 8, the locking portion 3 is mounted at a front end of the frame 1, and in a locked state of the front cover 5, the highest point of the locking portion 3 is higher than the lowest point of the front cover 5. Further, one side of the locking portion 3 facing the front cover 5 is further provided with a mounting groove. A limiting assembly 7 is embedded within the mounting groove. The limiting assembly 7 includes a limiting member 71 movably embedded within the mounting groove, an elastic member 72 two ends of which abut against the rear end of the limiting member 71 and an inner bottom surface of the mounting groove respectively, wherein one end of the limiting member 71 away from the elastic member 72 is capable of protruding from the mounting groove under the action of the elastic member 72, such that after the dust barrel 2 and the front cover 5 are mounted in place, the limiting assembly 7 further pushes against the front cover 5 to achieve pressing and sealing effects. Furthermore, as shown in FIG. 10, a position where the electric fan assembly 4 is hinged to the frame 1 is lower than the lowest point of the front cover 5, which ensures that a case where the electric fan assembly 4 may not be rotated because of supporting against the locking portion 3 may be avoided in a rotating process. However, on the premise that a gap between the front cover 5 and the locking portion 3 is sufficiently large, such a problem may be avoided.

As a further preferred embodiment, as shown in FIG. 9, FIG. 10, FIG. 13 and FIG. 14, in this embodiment, a lower end of the front cover 5 is hinged to a lower end of a front side of the dust barrel 2. Furthermore, the front cover 5 may be connected to the lower end of the front side of the dust barrel 2 by means of a flexible material such as soft plastic. Further, the front cover 5 is hinged with the dust barrel 2 by means of a rotating member 8, wherein the rotating member 8 includes a connecting shaft 82, a fixed sleeve 81 mounted around the connecting shaft 82, a torsional spring 83 embedded within the fixed sleeve 81 and mounted around the connecting shaft 82. Edges of the lower ends of the front cover 5 and the dust barrel 4 are coaxially connected by the connecting shaft 82. The fixed sleeve 81 is snapped onto the dust barrel 2. One end of the torsional spring 83 abuts against an outer edge of the front cover 5 and provides the front cover 5 with a rotating force relative to the dust barrel 2, such that the front cover 5 may be automatically opened after being disengaged from the locking portion 3, but obviously, may be opened by means of its own gravity when no torsional spring 83 is designed, and is not limited thereto.

As a further preferred embodiment, the electric fan assembly 4 has a drive motor, a rear end of the electric fan assembly 4 has a rear cover with a through hole in a middle portion, the rear end of the electric fan assembly 4 is further provided with a display screen, and the display screen is embedded in the through hole in the rear cover.

Furthermore, in this embodiment, the above-mentioned locking portion 3 is arranged at the front end of the frame 1 and integrated with the frame 1, and has an air duct communicated to the dust barrel 2 through the frame 1 inside, and the locking portion 3 has an inserting port for connecting a dust collection accessory at a front end thereof, which is a conventional means, such that its detailed description will be omitted here. Meanwhile, the frame 1 further has various conventional members such as a battery pack and a drive button assembly. The electric fan assembly 4 is further internally provided with a circuit board.

Second Embodiment

Figure 15:
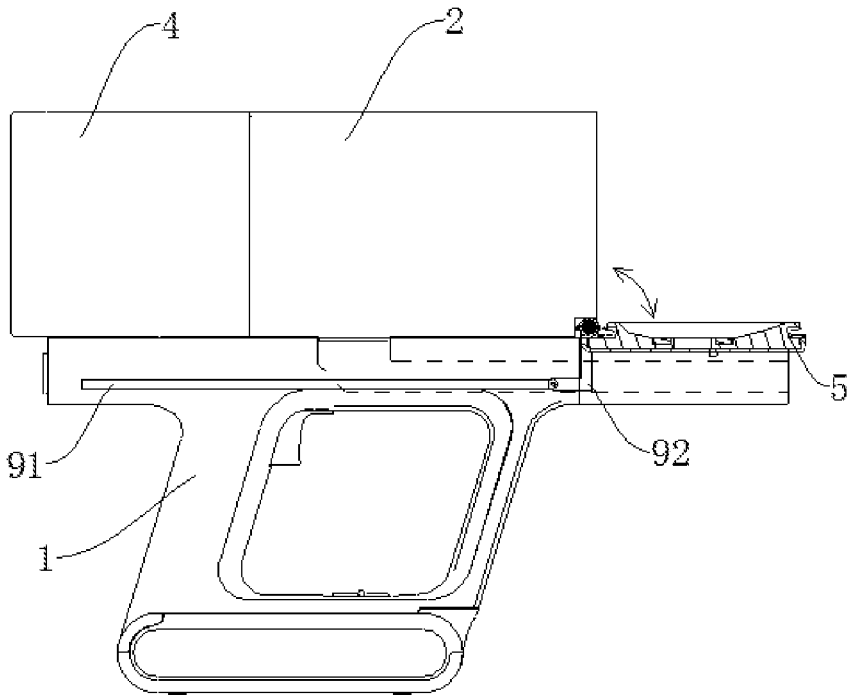
FIG. 15 is a first view showing a use state of a handheld vacuum cleaner according to a second embodiment of the present disclosure.
Figure 16:
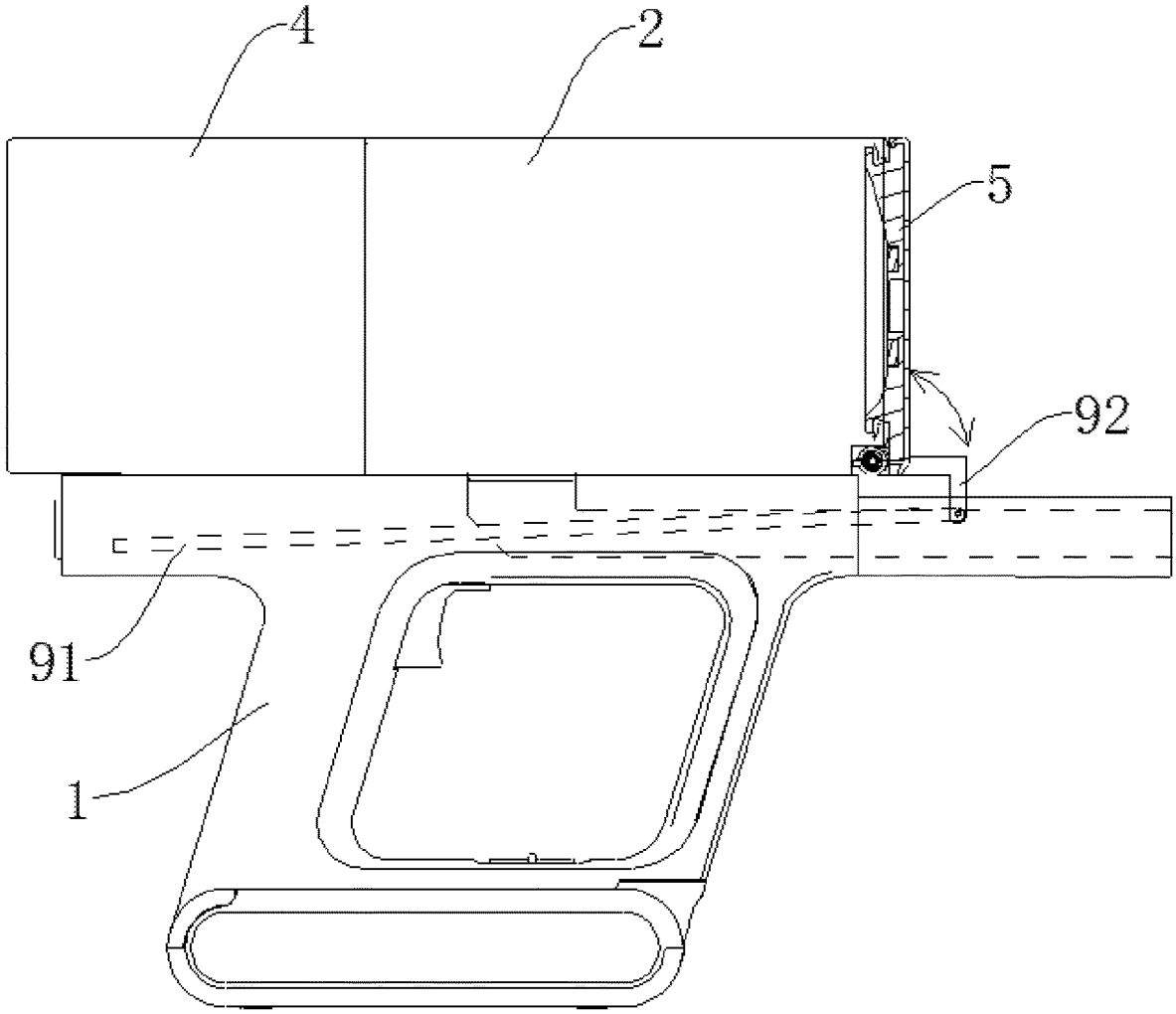
FIG. 16 is a second view showing a use state of the handheld vacuum cleaner according to the second embodiment of the present disclosure.

With reference to FIG. 15 and FIG. 16, structural features of the handheld vacuum cleaner provided in this embodiment are basically the same as those of the first embodiment, with differences only in that an electric fan assembly 4 and a dust barrel 2 are fixedly mounted on a frame 1, a locking portion 3 is a pushing rod 91 mounted inside the frame 1, a lower end of a front cover 5 is connected with an L-shaped connecting rod 92, one end of the pushing rod 91 is hinged to one end of the connecting rod 92 away from the front cover 5 and the other end thereof is connected to a button at a rear end of the frame 1, such that by pressing the button, the connecting rod 92 may be driven to rotate through the pushing rod 91, and further the front cover 5 may be driven to perform a rotating action. Furthermore, the pushing rod 91 may be moved by means of a pushing-buckling connection arranged on a side portion of the frame 1 and is not limited thereto.

Third Embodiment

Figure 17:
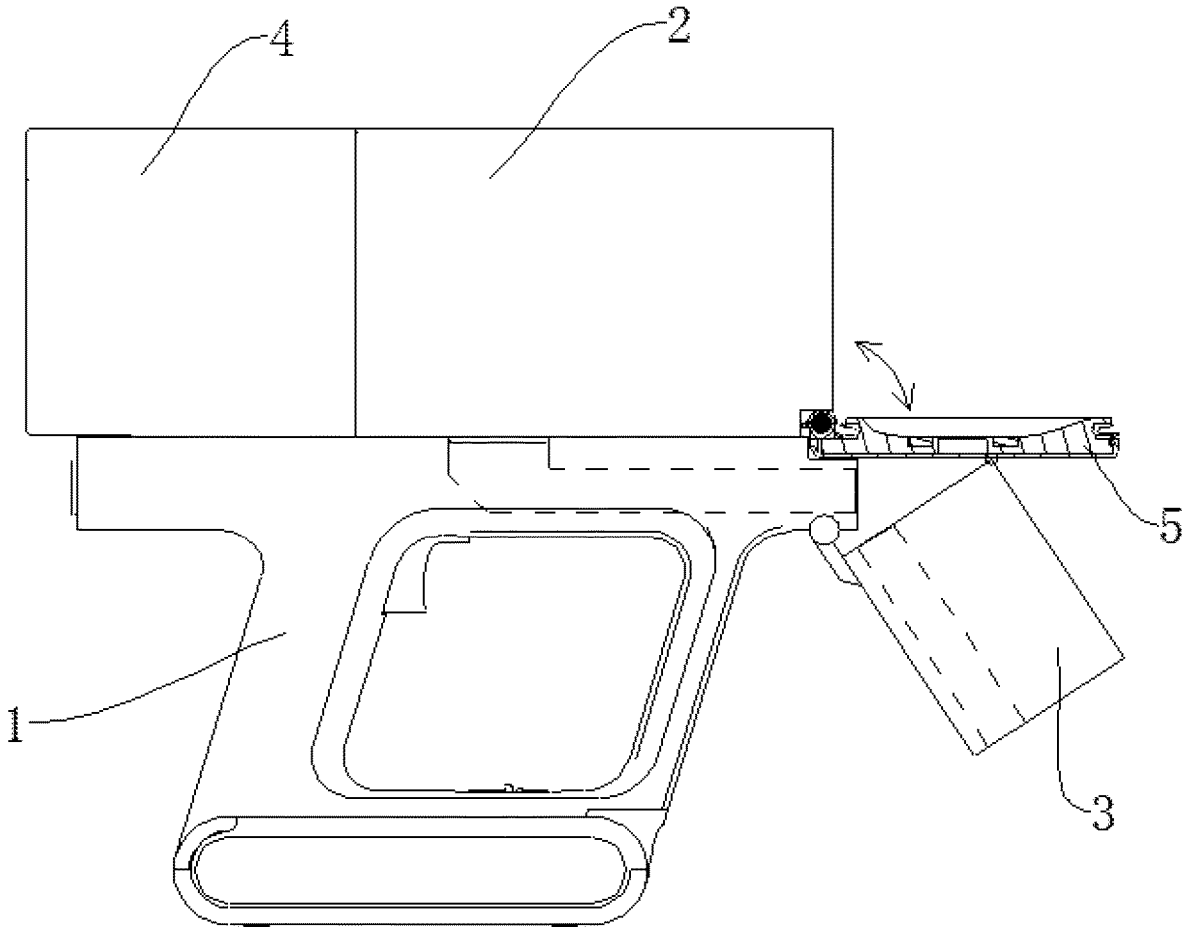
FIG. 17 is a first view showing a use state of a handheld vacuum cleaner according to a third embodiment of the present disclosure.
Figure 18:
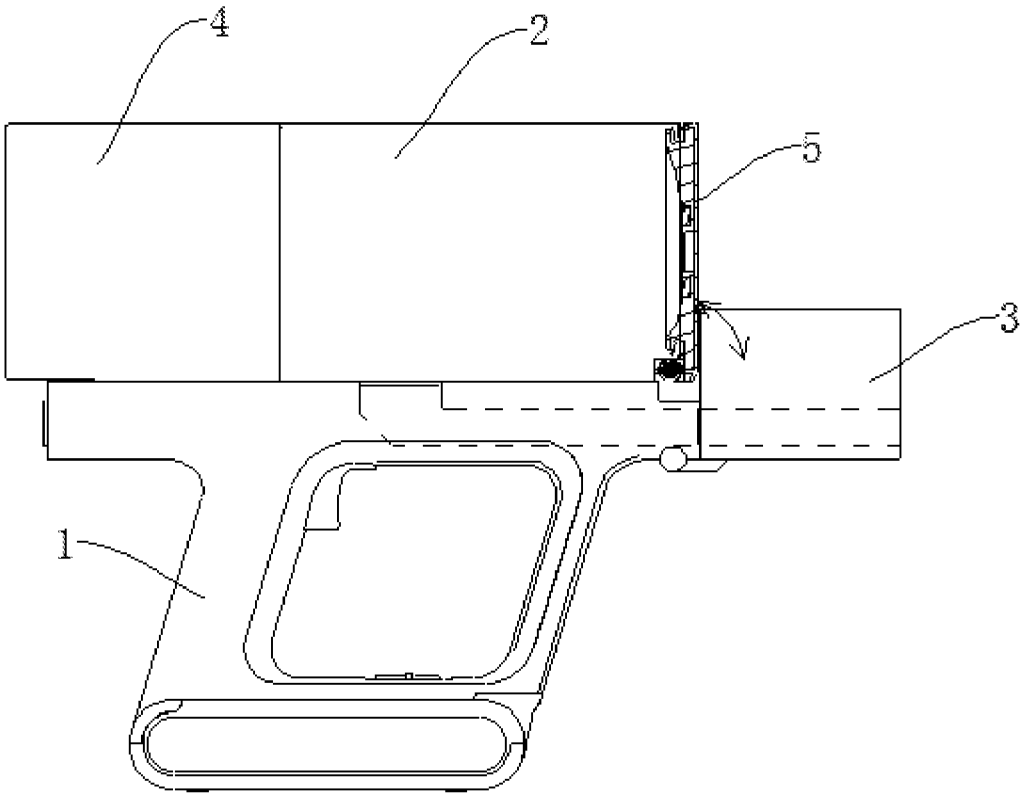
FIG. 18 is a second view showing the use state of the handheld vacuum cleaner according to the third embodiment of the present disclosure.

With reference to FIG. 17 and FIG. 18, structural features of the handheld vacuum cleaner provided in this embodiment are basically the same as those of the first embodiment, with differences only in that an electric fan assembly 4 and a dust barrel 2 are fixedly mounted on a frame 1, a locking portion 3 is hinged on the frame 1 and may be rotated relative to the frame 1 and opened; after the locking portion 3 is rotated, the front cover 5 of the dust barrel 2 is automatically rotated and opened; and after the locking portion 3 is reset, the front cover 5 is driven to be covered on a front end of the dust barrel 2. Further, one side of the locking portion 3 facing the front end of the frame 1 is provided with a first detachable connecting member, and one side of the front end of the frame 1 facing the locking portion 3 is provided with a second detachable connecting member corresponding to the first detachable connecting member in structure, such that fixation after the locking portion 3 is reset is achieved. Particularly, the detachable connecting member may be a strong magnetic attracting structure, or may be a corresponding snap structure 21. Moreover, in this embodiment, the locking portion 3 further serves as a connector by which the frame 1 is connected with an external dust collecting accessory.

Fourth Embodiment

Figure 19:
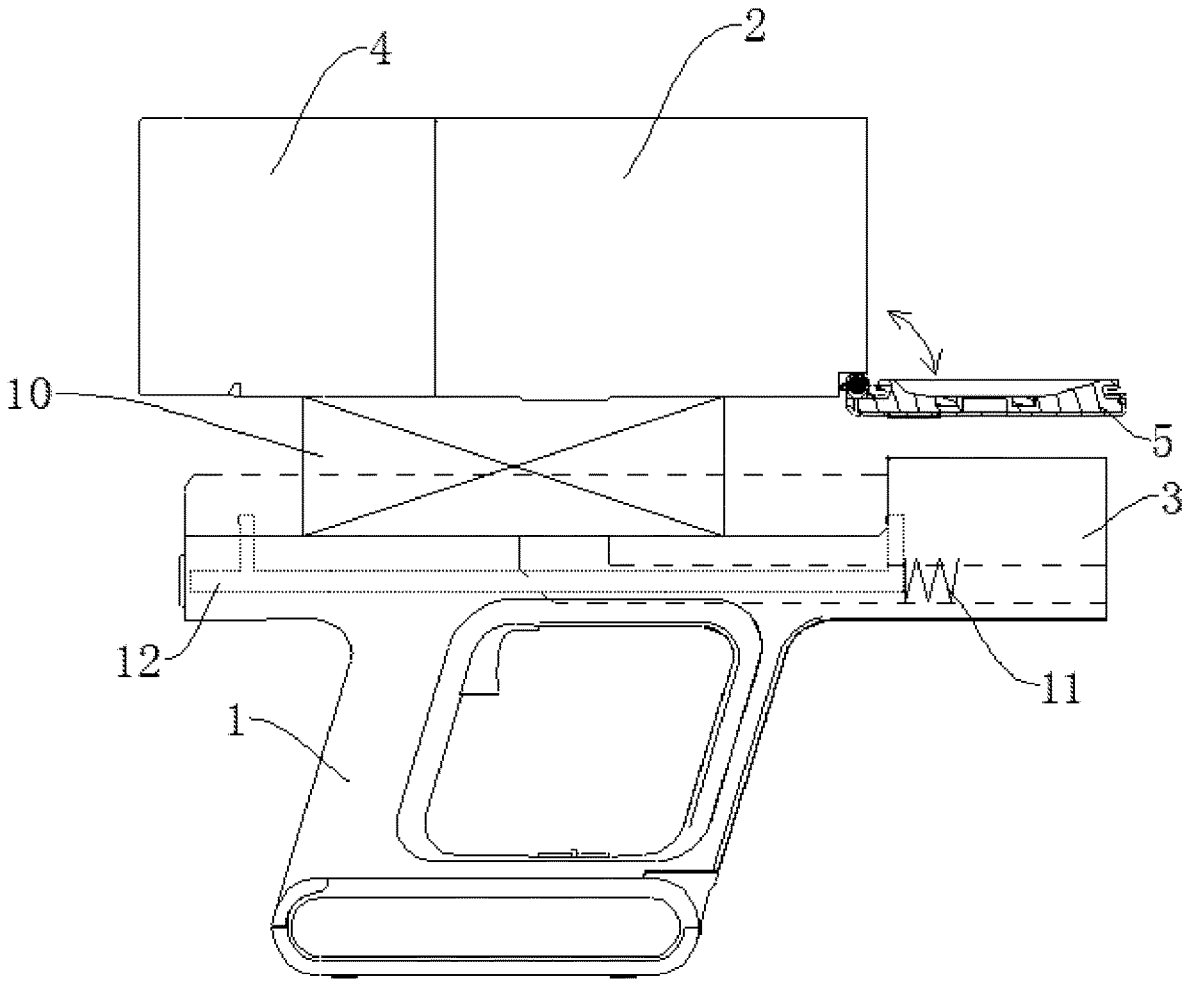
FIG. 19 is a first view showing a use state of a handheld vacuum cleaner according to a fourth embodiment of the present disclosure.
Figure 20:
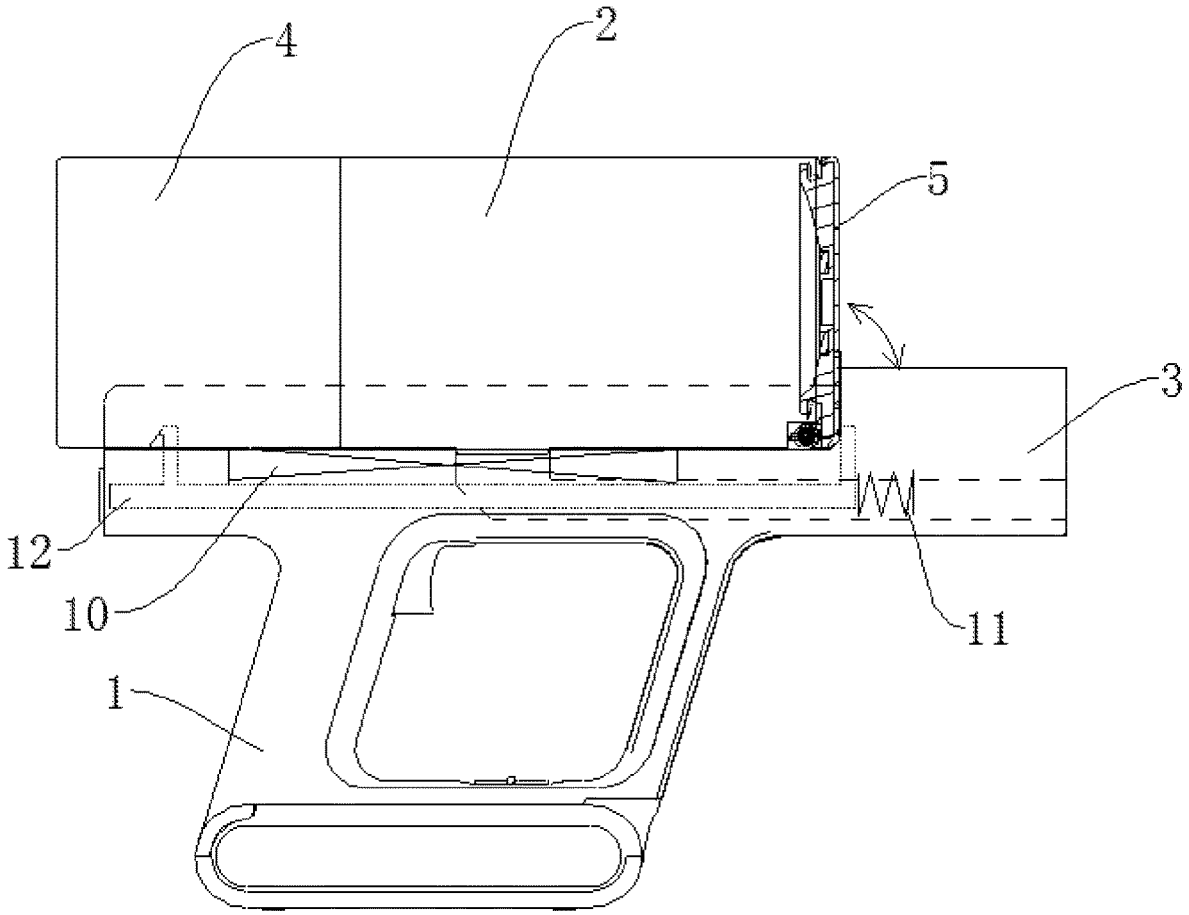
FIG. 20 is a second view showing the use state of the handheld vacuum cleaner according to the fourth embodiment of the present disclosure.

With reference to FIG. 19 and FIG. 20, structural features of the handheld vacuum cleaner provided in this embodiment are basically the same as those of the first embodiment, with differences only in that a dust barrel 3 is fixedly mounted on a front end of a frame 1, the dust barrel 2 and an electric fan assembly 4 is mounted on the frame 1 and can be lifted by means of a lifting member 10, and after the dust barrel 2 is lifted, the front cover 5 of the dust barrel 2 is released from a locking position of the locking portion 3 and automatically rotated and opened.

In a preferred embodiment, a lifting member 10 is a spring or a fork structure, or may be a series of electric and mechanical structures such as an electric pushing rod realizing a lifting state after the dust barrel 2 is unlocked. Further, the frame 1 is further provided with sliding grooves on two sides of each of the dust barrel 2 and the electric fan assembly 4, and two sides of each of the dust barrel 2 and the electric fan assembly 4 are provided with sliding blocks corresponding to the sliding grooves in structure to guide an action of longitudinally lifting the dust barrel 2 and the electric fan assembly 4. Meanwhile, an extending direction of the sliding grooves is not limited to a vertical direction, or the sliding grooves may for example extend upwards along an inclined-backward direction. Particularly lower ends of the dust barrel 2 and the electric fan assembly 4 also have buckling structures as described in the first embodiment, and a limiting member 63 is also arranged on the frame 1 to limit the stroke, but in fact, in this embodiment, when the fork structure or the electric pushing rod 91 is adopted, the stroke may be automatically limited, which is not limited thereto. Particularly, the frame 1 also has a linking member 12 inside configured to lock the lifting member 10, a button configured to drive the linking member 12 and a resetting spring 11 configured to reset the linking member 62.

Furthermore, in the embodiments 1 to 4, a structure in which the dust barrel 2 is directly mounted on a front end of an electric fan assembly 4 is adopted, but in fact, the electric fan assembly 4 may mounted on the frame 1. Accordingly, the above design is only a preferred design, and is not limited thereto.

A Fifth Embodiment

Figure 21:
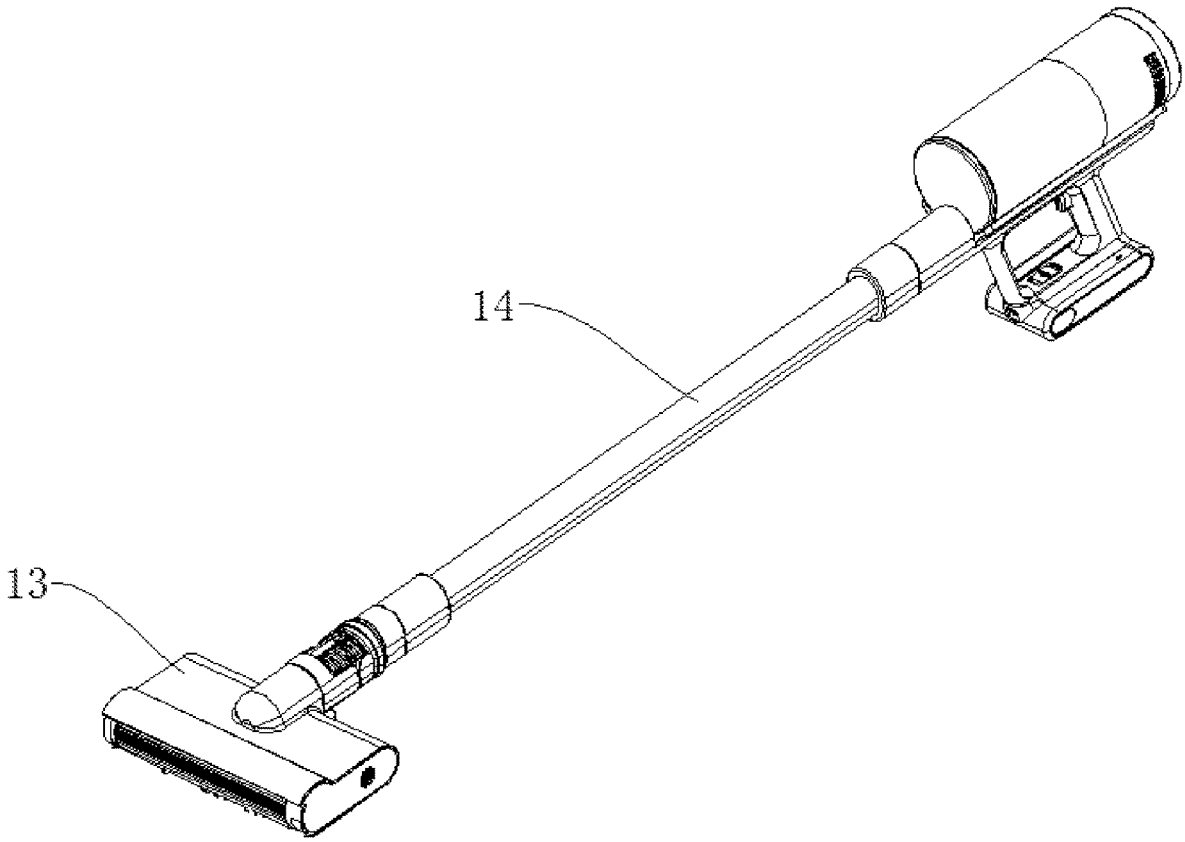
FIG. 21 is a perspective view of a handheld and upright integrated vacuum cleaner according to the present disclosure.

With reference to FIG. 21, the handheld and upright integrated vacuum cleaner provided in this embodiment includes the handheld vacuum cleaner described in any one of the embodiments 1 to 4, a connecting pipe 14 detachably connected to a front end of a locking portion 3 and a floor brushing assembly 13 mounted on one end of the connecting pipe 14 away from the handheld vacuum cleaner. It is possible to realize a change in a handheld or upright form by means of disassembly and assembly according to specific needs.

The above descriptions are only preferred embodiments of the utility model, which are merely illustrative rather than restrictive for the utility model. Those skilled in the art shall understand that many changes, modifications and even equivalents can be made within the spirit and scope defined by the claims of the utility model, but all fall within the protective scope of the utility model.

What is claimed is:

1. A handheld vacuum cleaner, comprising a frame, and a dust barrel and a locking portion mounted on the frame, wherein a front end of the dust barrel and the locking portion are movable relative to each other and are arranged opposite to each other; the dust barrel has a rotatable front cover at a front side thereof and when the locking portion and the dust barrel move with respect to each other, the front cover is automatically rotatable to open, or close on the front side of the dust barrel due to limit by the locking portion, wherein a rear end of the dust barrel is connected with an electric fan assembly, a rear end of the electric fan assembly is hinged on the frame, and the front end of the dust barrel is rotatable around a hinged end of the electric fan assembly to be disengaged from a locking position of the locking portion, so that the front cover is automatically opened.

2. The handheld vacuum cleaner according to claim 1, wherein a lower end of the front cover is hinged to a lower end of the front side of the dust barrel by means of a rotating member; the rotating member comprises a connecting shaft, a fixed sleeve mounted around the connecting shaft, and a torsional spring embedded within the fixed sleeve and mounted around the connecting shaft; edges of lower ends of the front cover and the dust barrel are coaxially connected by the connecting shaft; the fixed sleeve is snapped onto the dust barrel; and one end of the torsional spring abuts against an outer edge of the front cover and provides the front cover with a rotating force relative to the dust barrel.

3. The handheld vacuum cleaner according to claim 1, wherein a linkage limiting assembly is provided within the frame, the linkage limiting assembly comprises a triggering button arranged at a rear end of the frame, a pushing member configured to push the electric fan assembly or the dust barrel upwards, a limiting member configured to limit a maximum stroke of the electric fan assembly or the dust barrel, and a linking member connecting the triggering button with the limiting member in a force transmission manner.

4. The handheld vacuum cleaner according to claim 3, wherein the electric fan assembly or the dust barrel has a buckling structure at a lower end thereof arranged opposite to the limiting member, the limiting member is mounted within the frame and is rotatable back and forth, and one end of the linking member away from the triggering button abuts against the limiting member for driving the limiting member to perform a rotation action; and one side of the limiting member facing the buckling structure has a first flange buckling portion for limiting a minimum stroke of the buckling structure, and the frame has a second flange buckling portion therein for limiting a maximum stroke of the buckling structure.

5. A handheld and upright integrated vacuum cleaner, comprising the handheld vacuum cleaner according to claim 2, a connecting pipe detachably connected to a front end of the locking portion, and a floor brushing assembly mounted at one end of the connecting pipe away from the handheld vacuum cleaner.

6. The handheld and upright integrated vacuum cleaner according to claim 5, wherein a lower end of the front cover is hinged to a lower end of the front side of the dust barrel by means of a rotating member; the rotating member comprises a connecting shaft, a fixed sleeve mounted around the connecting shaft, and a torsional spring embedded within the fixed sleeve and mounted around the connecting shaft; edges of lower ends of the front cover and the dust barrel are coaxially connected by the connecting shaft; the fixed sleeve is snapped onto the dust barrel; and one end of the torsional spring abuts against an outer edge of the front cover and provides the front cover with a rotating force relative to the dust barrel.

7. The handheld and upright integrated vacuum cleaner according to claim 5, wherein a linkage limiting assembly is provided within the frame, the linkage limiting assembly comprises a triggering button arranged at a rear end of the frame, a pushing member configured to push the electric fan assembly or the dust barrel upwards, a limiting member configured to limit a maximum stroke of the electric fan assembly or the dust barrel, and a linking member connecting the triggering button with the limiting member in a force transmission manner.

8. The handheld and upright integrated vacuum cleaner according to claim 7, wherein the electric fan assembly or the dust barrel has a buckling structure at a lower end thereof arranged opposite to the limiting member, the limiting member is mounted within the frame and is rotatable back and forth, and one end of the linking member away from the triggering button abuts against the limiting member for driving the limiting member to perform a rotation action; and one side of the limiting member facing the buckling structure has a first flange buckling portion for limiting a minimum stroke of the buckling structure, and the frame has a second flange buckling portion therein for limiting a maximum stroke of the buckling structure.

9. A handheld vacuum cleaner, comprising a frame, and a dust barrel and a locking portion mounted on the frame, wherein a front end of the dust barrel and the locking portion are movable relative to each other and are arranged opposite to each other; the dust barrel has a rotatable front cover at a front side thereof and when the locking portion and the dust barrel move with respect to each other, the front cover is automatically rotatable to open, or close on the front side of the dust barrel due to limit by the locking portion, wherein the dust barrel is fixedly mounted on the frame, a lower end of the locking portion is hinged on the frame and the locking portion is rotatable to open relative to the frame; after the locking portion is rotated, the front cover of the dust barrel is automatically rotated and opened, and after the locking portion is reset in position, the front cover is driven to be covered on the front end of the dust barrel.

10. The handheld vacuum cleaner according to claim 9, wherein one side of the locking portion facing a front end of the frame is provided with a first detachable connecting member, and one side of the front end of the frame facing the locking portion is provided with a second detachable connecting member corresponding to the first detachable connecting member in structure.

11. The handheld vacuum cleaner according to claim 9, wherein a pushing rod is mounted inside the frame, the locking portion comprises an L-shaped connecting rod having a first end connected to a lower end of the front cover, and the pushing rod has one end hinged with a second end of the L-shaped connecting rod away from the front cover and an other end connected to a button which is provided on a rear end of the frame.

12. A handheld and upright integrated vacuum cleaner, comprising the handheld vacuum cleaner according to claim 9, a connecting pipe detachably connected to a front end of the locking portion, and a floor brushing assembly mounted at one end of the connecting pipe away from the handheld vacuum cleaner.

13. The handheld and upright integrated vacuum cleaner according to claim 12, wherein one side of the locking portion facing a front end of the frame is provided with a first detachable connecting member, and one side of the front end of the frame facing the locking portion is provided with a second detachable connecting member corresponding to the first detachable connecting member in structure.

14. The handheld and upright integrated vacuum cleaner according to claim 12, wherein a pushing rod is mounted inside the frame, the locking portion comprises an L-shaped connecting rod having a first end connected to a lower end of the front cover, and the pushing rod has one end hinged with a second end of the L-shaped connecting rod away from the front cover and an other end connected to a button which is provided on a rear end of the frame.

15. The handheld and upright integrated vacuum cleaner according to claim 12, wherein a lower end of the front cover is hinged to a lower end of the front side of the dust barrel by means of a rotating member; the rotating member comprises a connecting shaft, a fixed sleeve mounted around the connecting shaft, and a torsional spring embedded within the fixed sleeve and mounted around the connecting shaft; edges of lower ends of the front cover and the dust barrel are coaxially connected by the connecting shaft; the fixed sleeve is snapped onto the dust barrel; and one end of the torsional spring abuts against an outer edge of the front cover and provides the front cover with a rotating force relative to the dust barrel.

16. The handheld vacuum cleaner according to claim 9, wherein a lower end of the front cover is hinged to a lower end of the front side of the dust barrel by means of a rotating member; the rotating member comprises a connecting shaft, a fixed sleeve mounted around the connecting shaft, and a torsional spring embedded within the fixed sleeve and mounted around the connecting shaft; edges of lower ends of the front cover and the dust barrel are coaxially connected by the connecting shaft; the fixed sleeve is snapped onto the dust barrel; and one end of the torsional spring abuts against an outer edge of the front cover and provides the front cover with a rotating force relative to the dust barrel.

17. A handheld vacuum cleaner, comprising a frame, and a dust barrel and a locking portion mounted on the frame, wherein a front end of the dust barrel and the locking portion are movable relative to each other and are arranged opposite to each other; the dust barrel has a rotatable front cover at a front side thereof and when the locking portion and the dust barrel move with respect to each other, the front cover is automatically rotatable to open, or close on the front side of the dust barrel due to limit by the locking portion, wherein the locking portion is fixedly mounted on a front end of the frame, and the dust barrel is mounted on the frame and is liftable by a lifting member, and after the dust barrel is lifted, the front cover of the dust barrel is released from a locking position of the locking portion and automatically rotated and opened.

18. A handheld and upright integrated vacuum cleaner, comprising the handheld vacuum cleaner according to claim 17, a connecting pipe detachably connected to a front end of the locking portion, and a floor brushing assembly mounted at one end of the connecting pipe away from the handheld vacuum cleaner.

19. The handheld and upright integrated vacuum cleaner according to claim 18, wherein a lower end of the front cover is hinged to a lower end of the front side of the dust barrel by means of a rotating member; the rotating member comprises a connecting shaft, a fixed sleeve mounted around the connecting shaft, and a torsional spring embedded within the fixed sleeve and mounted around the connecting shaft; edges of the ends of the front cover and the dust barrel are coaxially connected by the connecting shaft; the fixed sleeve is snapped onto the dust barrel; and one end of the torsional spring abuts against an outer edge of the front cover and provides the front cover with a rotating force relative to the dust barrel.

20. The handheld vacuum cleaner according to claim 17, wherein a lower end of the front cover is hinged to a lower end of the front side of the dust barrel by means of a rotating member; the rotating member comprises a connecting shaft, a fixed sleeve mounted around the connecting shaft, and a torsional spring embedded within the fixed sleeve and mounted around the connecting shaft; edges of lower ends of the front cover and the dust barrel are coaxially connected by the connecting shaft; the fixed sleeve is snapped onto the dust barrel; and one end of the torsional spring abuts against an outer edge of the front cover and provides the front cover with a rotating force relative to the dust barrel.

* * * * *